US009574764B2

(12) United States Patent
Kowalski et al.

(10) Patent No.: US 9,574,764 B2
(45) Date of Patent: Feb. 21, 2017

(54) PORTABLE STEAM GENERATING DEVICE

(71) Applicant: S.C. Johnson & Son, Inc., Racine, WI (US)

(72) Inventors: Tara L. Kowalski, Union Grove, WI (US); Wayne Rees, Racine, WI (US); Ronald H. Spang, Kenosha, WI (US); Jennifer R. Harris, Shorewood, WI (US); Xiaolan Wei, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 678 days.

(21) Appl. No.: 13/900,714

(22) Filed: May 23, 2013

(65) Prior Publication Data

US 2013/0312212 A1 Nov. 28, 2013

Related U.S. Application Data

(60) Provisional application No. 61/651,651, filed on May 25, 2012.

(51) Int. Cl.
*F22B 27/04* (2006.01)
*F22B 35/00* (2006.01)
(Continued)

(52) U.S. Cl.
CPC ..... *F22B 27/04* (2013.01); *A47L 11/34* (2013.01); *A47L 11/4086* (2013.01);
(Continued)

(58) Field of Classification Search
CPC .... A47L 11/34; A47L 13/225; A47L 11/4086; A47L 11/4088; A47L 13/16; A47L 13/20; A47L 13/256; F22B 1/282; F22B 1/285; F22B 35/005
See application file for complete search history.

(56) References Cited

U.S. PATENT DOCUMENTS 4,017,414 A 4/1977 Black et al.
4,100,324 A 7/1978 Anderson et al.
(Continued)

FOREIGN PATENT DOCUMENTS

CN 201454906 U 5/2010
WO 2004024337 A2 3/2004
(Continued)

OTHER PUBLICATIONS

US 8,082,621, 12/2011, Rosenzweig et al. (withdrawn)

*Primary Examiner* — Robert Scruggs

(57) ABSTRACT

A steam generating device has a handle and a nozzle or pad attached to the handle for treating a surface. The handle includes a heat exchanger, a water reservoir, a fluid conduit in fluid communication with the water reservoir and heat exchanger, and a fluid delivery system for moving water from the water reservoir, through the fluid conduit, and into the heat exchanger. A fuel powered heater is positioned on a side of the wall of the heat exchanger opposite the interior space of the heat exchanger. A first section of the wall of the heat exchanger transfers heat from the heater to water located in the heat exchanger for generating steam from the water located in the heat exchanger. A second section of the wall of the heat exchanger includes an opening that allows steam to exit the heat exchanger and handle and flow through the nozzle or pad.

16 Claims, 7 Drawing Sheets

(51) Int. Cl.

| | |
|---|---|
| ***A47L 11/34*** | (2006.01) |
| ***A47L 11/40*** | (2006.01) |
| ***A47L 13/22*** | (2006.01) |
| ***F22B 1/28*** | (2006.01) |

(52) U.S. Cl.

CPC ..... *A47L 13/225* (2013.01); *F22B 1/285* (2013.01); *F22B 35/005* (2013.01)

(56) References Cited

U.S. PATENT DOCUMENTS 4,264,362 A 4/1981 Sergev et al.
4,282,903 A 8/1981 Powell
4,522,190 A 6/1985 Kuhn et al.
4,699,123 A 10/1987 Zaborowski
4,716,885 A 1/1988 Zaborowski
4,733,651 A 3/1988 Schawbel et al.
4,759,343 A 7/1988 Schawbel et al.
4,776,321 A 10/1988 Schawbel et al.
4,815,441 A 3/1989 Schawbel et al.
4,852,546 A 8/1989 Zaborowski
4,911,186 A 3/1990 Hayden
4,917,078 A 4/1990 Zaborowski
4,924,849 A 5/1990 Zaborowski
4,949,424 A * 8/1990 Shero ..... A47L 11/34 15/321
5,476,376 A 12/1995 Santhouse et al.
5,485,829 A 1/1996 Santhouse et al.
5,517,981 A 5/1996 Taub et al.
5,611,329 A 3/1997 Lamensdorf
5,674,270 A 10/1997 Viltro et al.
5,700,430 A 12/1997 Bonnema et al.
5,837,005 A 11/1998 Viltro et al.
5,857,262 A 1/1999 Bonnema et al.
5,928,605 A 7/1999 Bonnema et al.
5,935,486 A 8/1999 Bell et al.
5,944,508 A 8/1999 Bonnema
5,984,995 A 11/1999 White
6,033,212 A 3/2000 Bonnema et al.
6,036,391 A 3/2000 Holliday et al.
6,085,739 A 7/2000 Leiss
6,096,067 A 8/2000 Cramer et al.
6,158,427 A 12/2000 McGuire et al.
6,248,257 B1 6/2001 Bell et al.
6,249,996 B1 6/2001 Dorber et al.
6,289,889 B1 9/2001 Bell et al.
6,309,598 B1 10/2001 Tully
6,436,128 B1 8/2002 Usui
6,508,602 B1 1/2003 Gruenbacher et al.
6,629,964 B1 10/2003 Ono et al.
6,863,682 B2 3/2005 Usui
7,021,848 B1 4/2006 Gruenbacher et al.
7,073,226 B1 7/2006 Lenkiewicz et al.
7,100,540 B2 9/2006 Vaughan
7,108,440 B1 9/2006 Gruenbacher et al.
D530,594 S 10/2006 Soller et al.
7,153,371 B2 12/2006 Hansen et al.
7,163,349 B2 1/2007 Policicchio et al.
7,182,739 B2 2/2007 Kopanic et al.
7,210,185 B2 5/2007 Paas
7,255,506 B2 8/2007 Gruenbacher et al.
7,258,117 B2 8/2007 Payen et al.
7,476,047 B2 1/2009 Brunner et al.
7,568,255 B1 8/2009 Krebs
7,624,468 B2 12/2009 Reddy et al.
7,650,667 B2 1/2010 Rosenzweig et al.
7,652,228 B2 1/2010 Igaki et al.
7,749,401 B2 7/2010 Roselle et al.
7,774,895 B2 8/2010 Hansen et al.
7,794,649 B2 9/2010 Wong et al.
7,835,631 B2 11/2010 Wang et al.
7,856,948 B2 12/2010 Wong et al.
7,878,187 B2 2/2011 York-Leung Wong
7,883,640 B2 2/2011 Doona et al.
7,954,201 B1 6/2011 Martinez
7,971,585 B2 7/2011 Bommaraju
8,080,172 B2 12/2011 Iannicelli
2002/0035756 A1 3/2002 Pace et al.
2002/0040503 A1 4/2002 Pace et al.
2003/0041407 A1* 3/2003 Savage ..... A47L 11/34 15/321
2003/0101984 A1 6/2003 Li et al.
2004/0168684 A1 9/2004 Shapiro et al.
2005/0037937 A1 2/2005 Pace et al.
2006/0185622 A1 8/2006 Snyder
2007/0020412 A1 1/2007 Kumamoto et al.
2007/0079470 A1* 4/2007 Rippl ..... A47L 11/34 15/320
2007/0119487 A1 5/2007 Taylor et al.
2007/0131248 A1 6/2007 McKechnie
2007/0167341 A1 7/2007 Burt et al.
2007/0209139 A1* 9/2007 Carlucci ..... A47L 11/34 15/322
2007/0272090 A1 11/2007 Bommaraju
2008/0066789 A1 3/2008 Rosenzweig et al.
2008/0128032 A1 6/2008 Lapetina et al.
2008/0166176 A1 7/2008 Rees et al.
2008/0236635 A1 10/2008 Rosenzweig et al.
2009/0000051 A1 1/2009 Rosenzweig et al.
2009/0148570 A1 6/2009 Bommaraju
2009/0223383 A1 9/2009 Houraney
2010/0024146 A1 2/2010 Rosenzweig et al.
2010/0116298 A1 5/2010 Rosenzweig et al.
2010/0136186 A1 6/2010 Bommaraju
2010/0139639 A1 6/2010 Igaki et al.
2010/0147282 A1 6/2010 Urume et al.
2010/0154822 A1 6/2010 Reed, Jr. et al.
2010/0186463 A1* 7/2010 Vrdoljak ..... A47L 13/22 68/222
2010/0198325 A1 8/2010 Ishikawa
2010/0276416 A1 11/2010 Wang et al.
2010/0319411 A1 12/2010 Roselle et al.
2011/0108761 A1 5/2011 Wong et al.
2011/0126821 A1 6/2011 Wilson et al.
2011/0180754 A1 7/2011 Doona et al.
2011/0223375 A1 9/2011 Kaminer et al.
2012/0042462 A1 2/2012 Milanese et al.
2012/0204376 A1* 8/2012 Charlton ..... A47L 13/225 15/322

FOREIGN PATENT DOCUMENTS

WO 2005011543 A1 2/2005
WO 2005041740 A1 5/2005
WO 2005058213 A1 6/2005
WO 2005093029 A1 10/2005
WO 2007061773 A2 5/2007
WO 2007103580 A2 9/2007
WO 2007122900 A1 11/2007
WO 2008030799 A2 3/2008
WO 2009022624 A1 2/2009
WO 2009102718 A1 8/2009

* cited by examiner

PORTABLE STEAM GENERATING DEVICE

CROSS-REFERENCES TO RELATED APPLICATIONS

This application claims priority from U.S. patent application Ser. No. 61/651,651 filed May 25, 2012.

STATEMENT REGARDING FEDERALLY SPONSORED RESEARCH

Not Applicable.

BACKGROUND OF THE INVENTION

1. Field of the Invention

This invention relates to a portable device that can be used to generate steam.

2. Description of the Related Art

Steaming devices used to apply steam to objects are known. Steaming devices can apply steam to drapes or garment fabrics to remove wrinkles. Steam-generating warming articles for use on a surface of the human body are also known. See, for example, U.S. Pat. No. 7,652,228. Devices have also been developed for applying steam to a hard surface to assist in the cleaning of the surface. For example, U.S. Patent Application Publication No. 2008/0236635 discloses a steam mop.

While the benefits of steam-generating devices in surface treating are known, these devices often require an electrically-powered boiler to generate steam and an associated pump system to direct the steam towards its intended destination. The boiler and pump often require plugging the device into an AC electrical outlet and therefore, these devices cannot be used where an AC electrical outlet is unavailable. Thus, these devices are not truly portable, and battery operated or rechargeable units are heavy and have limited operational times. Also, all electrical versions require some start up time.

What is needed therefore is a portable steam generating device suitable for surface treating applications that does not require an AC electrical outlet and that can be used to treat soft surfaces, such as fabric, and/or hard surfaces, such as floors, walls, sinks, countertops, bathtubs, toilets, other bathroom fixtures, and inner surfaces of an enclosure.

SUMMARY OF THE INVENTION

The invention provides a hand-held, steam generating household cleaning device, which has capability to clean small spaces and irregularly shaped curved spaces, as well as larger flat surfaces. Preferably, the device is capable of emitting a controllable or on-demand, focused stream/plume of steam for cleaning in small, "tight" spaces and irregularly shaped objects (such as faucets). In addition, it is also preferable that the device is fitted with a flat, pad-like steam outlet adaptor to allow to the effective cleaning of larger flat surfaces. Alternatively, the steam outlet adaptor can use a softer moldable surface that has some ability to mold around non-flat objects, such as sink edges and faucets.

In one embodiment, the invention provides a portable steam generating device including a handle and a fluid permeable pad attached to the handle. The handle includes a heat exchanger having a wall defining an interior space of the heat exchanger, a water reservoir, a fluid conduit in fluid communication with the water reservoir and the interior space of the heat exchanger, a fluid delivery system for moving water from the water reservoir, through the fluid conduit, and into the interior space of the heat exchanger, and a fuel powered heater positioned on a side of the wall of the heat exchanger opposite the interior space of the heat exchanger. A first section of the wall of the heat exchanger transfers heat from the heater to water located in the interior space of the heat exchanger for generating steam from the water located in the interior space of the heat exchanger. A second section of the wall of the heat exchanger includes an opening that allows steam to exit the interior space of the heat exchanger and exit the handle and flow through the pad.

The pad may include a first layer bound to a second layer around a periphery of the first layer and a periphery of the second layer, wherein the second layer is constructed to form a first part of an attachment system, and the handle is constructed to form a second part of the attachment system with the handle being attached to the second layer.

The pad may include a first layer bound to a second layer around a periphery of the first layer and a periphery of the second layer, wherein the second layer includes an aperture, and the aperture is positioned in the second layer such that the aperture aligns with the opening in the second section of the wall of the heat exchanger when the pad is attached to the handle. The pad may have a single layer, and the pad may have one or more apertures.

The second section of the wall of the heat exchanger may include one of more additional openings that each allow steam to exit the interior space of the heat exchanger and exit the handle and flow through the pad, wherein the pad includes a first layer bound to a second layer around a periphery of the first layer and a periphery of the second layer, the second layer includes a plurality of apertures, and each aperture is positioned in the second layer such that each aperture aligns with one of the openings in the second section of the wall of the heat exchanger when the pad is attached to the handle.

In another embodiment, the invention provides a portable steam generating device including a handle and a removable steam nozzle attached to the handle. The handle includes a heat exchanger having a wall defining an interior space of the heat exchanger, a water reservoir, a fluid conduit in fluid communication with the water reservoir and the interior space of the heat exchanger, a fluid delivery system for moving water from the water reservoir, through the fluid conduit, and into the interior space of the heat exchanger, and a fuel powered heater positioned on a side of the wall of the heat exchanger opposite the interior space of the heat exchanger. A first section of the wall of the heat exchanger transfers heat from the heater to water located in the interior space of the heat exchanger for generating steam from the water located in the interior space of the heat exchanger, and a second section of the wall of the heat exchanger includes an opening that allows steam to exit the interior space of the heat exchanger and exit the handle. An inlet of the nozzle is in fluid communication with the opening in the second section of the wall of the heat exchanger, and the nozzle converges from the inlet of the nozzle to an outlet of the nozzle.

In yet another embodiment, the invention provides a portable steam generating device including a handle and a removable steam nozzle attached to the handle. The handle includes a heat exchanger having a wall defining an interior space of the heat exchanger, a water reservoir, a fluid conduit in fluid communication with the water reservoir and the interior space of the heat exchanger, a fluid delivery system for moving water from the water reservoir, through the fluid conduit, and into the interior space of the heat exchanger, and a fuel powered heater positioned on a side of the wall of the heat exchanger opposite the interior space of the heat exchanger. A first section of the wall of the heat exchanger transfers heat from the heater to water located in the interior space of the heat exchanger for generating steam from the water located in the interior space of the heat exchanger, and a second section of the wall of the heat exchanger includes an opening that allows steam to exit the interior space of the heat exchanger and exit the handle. An inlet of the nozzle is in fluid communication with the opening in the second section of the wall of the heat exchanger, and an outlet of the nozzle is angled obliquely with respect to an axis of the inlet of the nozzle. A fluid permeable pad may be attached to the nozzle, and the pad covers an outlet of the nozzle. A brush may be attached to the nozzle, and the brush may be adjacent an outlet of the nozzle.

In any of the embodiments, the heater may include a combustion chamber. The heater may further include a source of fuel and a fuel conduit in fluid communication with the source of fuel and the combustion chamber. The heater may further include a fuel metering valve in the fuel conduit, wherein the fuel metering valve has a closed position in which fuel cannot move from the source of fuel and through the fuel conduit, and into the combustion chamber, and the fuel metering valve has an open position in which fuel can move from the source of fuel, and through the fuel conduit, and into the combustion chamber. The source of fuel may include a disposable pressurized fuel-filled cartridge. The source of fuel may include a fuel storage chamber located within the handle, and the fuel storage chamber is suitable for fluidly interfacing with an external pressurized fuel canister for refilling the fuel storage chamber. An igniter may be in fluid communication with a combustion zone defined by the combustion chamber, and the igniter can ignite fuel in the combustion zone. The igniter may include a sparking mechanism. The sparking mechanism may include a piezoelectric material. The sparking mechanism may include a pyrophoric material.

In any of the embodiments, the heater may be a catalytic heater. In any of the embodiments, the fuel may be selected from the group consisting of $C_1$ to $C_5$ hydrocarbons and mixtures thereof. In any of the embodiments, the fuel may be selected from butane, isobutane and propane.

In any of the embodiments, the fluid delivery system meters water into the heat exchanger at a rate commensurate with heat generation from the heater such that a low temperature steam exits the handle. The fluid delivery system may include a variable volume pump chamber in fluid communication with the water reservoir and the fluid conduit, wherein the variable volume pump chamber moves water from the water reservoir, through the fluid conduit, and the interior space of the heat exchanger. The volume of the pump chamber may be varied by an actuator on the handle. The fluid delivery system may include a fluid delivery valve capable of providing active fluid metering. The fluid delivery valve may include a closed position in which water cannot move from the water reservoir and through the fluid conduit, and into the interior space of the heat exchanger, and an open position in which water can move from the water reservoir, and through the fluid conduit, and into the interior space of the heat exchanger.

In any of the embodiments, the device converts about 1 to about 10 grams of water per minute to steam. In any of the embodiments, the steam exiting the device is in a temperature range of about 175° F. to about 300° F., more preferably in a temperature range of about 190° F. to about 220° F. In any of the embodiments, the steam exiting the device is sufficient in temperature and volume such that a surface being treated with the device is disinfected or sanitized.

The invention also provides a method for cleaning and/or sanitizing and/or disinfecting a surface. In the method, any of the embodiments of the portable steam generating device are placed on or adjacent the surface to contact the surface with steam produced by the device. The surface may be selected from floors, walls, countertops, sinks, bathtubs, toilets, bathroom fixtures, and inner surfaces of an enclosure. The surface may be a flat surface. The surface may be a curved surface.

A portable device of the invention can include one or more of the following features: a cleaning surface made of non-woven pad with scrubbing capabilities; a fuel supply and fuel metering mechanism; an ignition mechanism; a controlled-burn mechanism to generate heat; a water dosing and metering mechanism to facilitate controllable or on-demand steam generation; and a heat exchange mechanism to heat and evaporate water. The heat exchange mechanism can include an object to be directly heated by combustion of a fuel, a contact interface between the heated object and water, and an exit for converted steam to eject from the device.

Some suitable non-limiting uses for a portable steam generating device according to the invention include: (i) handheld steam disinfecting/cleaning of hard surfaces; (ii) floor steam disinfecting/cleaning; (iii) fabric, furniture, drapery steaming; (iii) clothing steaming; (iv) carpet stain removal; (v) a heater element supplied as a cartridge to go into a hard molded device, e.g., a cylindrical device where a user inserts a heater cartridge into the center and rolls it across a surface; and (vi) a heat/steam energy source such as a mini steam engine. The steam generating device can be used as household surface cleaning device for flat, large surfaces (e.g. kitchen counter and floor), or the device can be used as a household surface cleaning device for curved, small surfaces (e.g. faucet).

These and other features, aspects, and advantages of the present invention will become better understood upon consideration of the following detailed description, drawings and claims.

BRIEF DESCRIPTION OF THE DRAWINGS

Like reference numerals will be used to refer to like parts from Figure to Figure in the following description of the drawings.

DETAILED DESCRIPTION OF THE INVENTION

Figure 1:
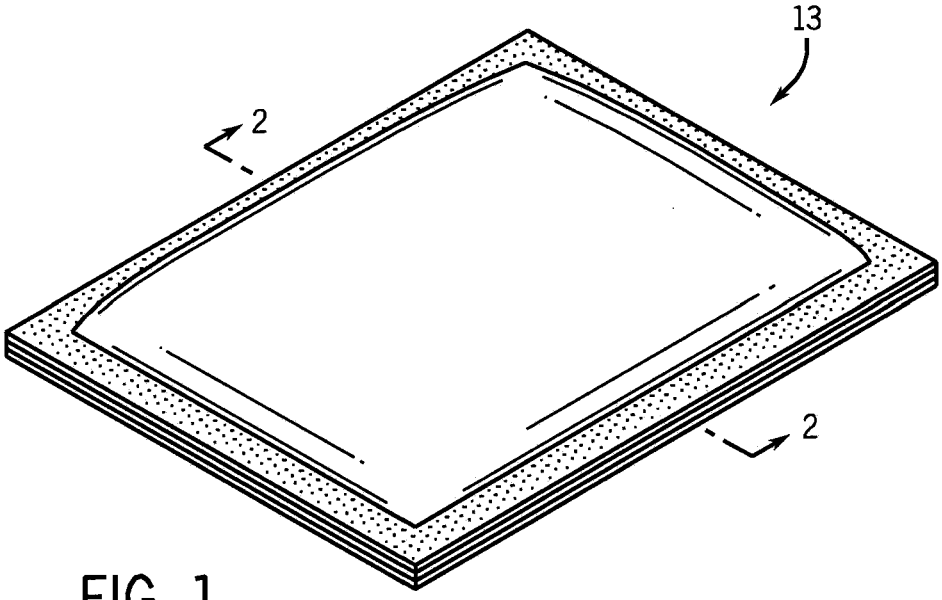
FIG. 1 is a perspective view of a three layer surface treating pad used in one embodiment of a steam generating device according to the present invention.
Figure 2:
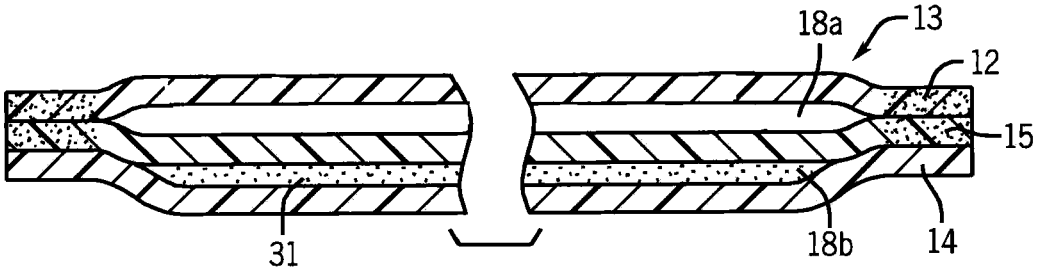
FIG. 2 is a cross-sectional view of the three layer surface treating pad of FIG. 1 taken along line 2-2 of FIG. 1.

FIGS. 1 and 2 show an example embodiment of a three layer surface treating pad 13 used in one embodiment of a steam generating device of the present invention. The three-layer pad 13 includes outer layers 12 and 14. The layer 12 is fluid-permeable, and optionally abrasive if the pad 13 is used for cleaning surfaces. The middle layer 15 is sandwiched between the outer layers 12 and 14. The middle layer 15 is water absorbent. The layers 12, 14 and 15 are sealed around the periphery of the layers 12 and 14 and 15 to define a cavity 18*a* between layers 12 and 15 and a cavity 18*b* between layers 14 and 15. The layers 12 and 14 form an outer cover for the pad 13. A blend of scrubbing and absorbent properties may be beneficial for the pad 13. Although absorbent properties can be used in layer 15 of the pad 13, the layer 12 and/or the layer 14 do not necessarily need absorbent properties.

In non-limiting example forms, the layers 12, 14 and 15 can be a sheet of woven or non-woven fabric, textile-like material, foamed sheet, or plastic sheeting, or combinations thereof. One or more of layers 12, 14 and 15 may be of a porous nature, so as to allow the passage of steam and/or an aqueous cleaning solution. The pad 13 may also be constructed of at least one water-impervious layer, such as a polyethylene sheet, that includes one or more openings to allow for the passage of steam. The outer edges of the layers 12, 14 and 15 are preferably bonded or joined together by stitching, heat welding, sonic welding, adhesive or other means. Preferably, the outer edges of the layers 12, 14 and 15 are bonded together around at least half their periphery, and most preferably, the outer edges of the layers 12, 14 and 15 are bonded together around their entire periphery, the joined adjacent layers forming the sealed cavities 18*a*, 18*b*.

When the pad 13 is intended for cleaning hard surfaces, the layer 12 which faces the surface to be cleaned may include polymeric fibers in a shape suitable for providing abrasion. The polymeric fibers in the layer 12 are generally arranged to form an open, porous fluid-permeable structure. All of the layer 12 may be fluid-permeable, or certain sections of the layer 12 may be fluid-permeable. The layer 12 is capable of providing a scrubbing function, rather than just polishing, wiping or drying functions. In one form, the layer 12 has a basis weight of about 10 g/m$^2$ to about 300 g/m$^2$. In a non-limiting example embodiment, the layer 12 can be made of polyester/acrylic resin material such as 100% polyester fibers bonded together with an acrylic resin binder. One suitable abrasive layer is the material sold as Matador Grade RD3370-2 (Matador Converters Co. Ltd., Canada), which is 100% polyester fibers bonded together with an acrylic resin binder. The abrasiveness of the abrasive layer can be varied depending on the intended use of the product. For example, the abrasiveness can be increased by providing elevated and depressed regions in the surface of the layer 12. Also, the fiber materials, fiber length, fiber cross-section, fiber diameter, layer basis weight, etc. may all vary depending on the desired abrasiveness of the abrasive layer.

The layer 14 can be constructed to be suitable for forming a hook and loop type attachment system with a corresponding surface on a mounting handle. In a non-limiting example embodiment, the layer 14 could be made of at least partially synthetic non-woven material mounted on a synthetic extrusion film. The outer surface of the layer 14 can be the non-woven material which functions as the loop material for the hook and loop type attachment system (such as a Velcro™ assembly system) without the need for a separate loop strip. In one form, the layer 14 is a polyester spunlaced nonwoven material mounted on a polyethylene extrusion film (about 25 micrometers thick), such as sold by Ahlstrom Grade 26032 (Ahlstrom Windsor Locks LLC, Connecticut, USA). Certain sections of the layer 14 may be fluid impermeable such that steam is only directed through certain sections of the later 14. For example, apertures 86 can provide a fluid path through otherwise fluid impermeable sections of the layer 14. The extrusion film of the layer 14 can also perform a heat barrier function, that is, the film can limit heat transfer toward the outer surface of the layer 14.

The layer 15 (which is in the middle in a three-layer structure) can be made of at least a partially synthetic non-woven material. One suitable porous middle layer is the material sold as Matador Grade FF0305, which is a 100% polyester nonwoven material. Another suitable porous absorbent middle layer is the material sold as Matador Grade RD3370-2, which is 100% polyester fibers bonded together with an acrylic resin binder. Another suitable material for layer 15 is an absorbent at least partially synthetic material sold as Ahlstrom Grade 12236, which is a non-woven fabric formed from a pulp/synthetic mix.

When the pad 13 is used for cleaning surfaces, it can be beneficial to incorporate a surface treating material 31 into the pad 13. Non-limiting examples of a surface treating material include one or more of the following: anionic surfactants, nonionic surfactants, cationic surfactants, amphoteric/zwitterionic surfactants, detergent builders, chelating agents, rinse aids, surface modifying anti-resoiling agents, inorganic or organic pH buffering agents, solid hydrotroping agents, dyes, fragrances, odor eliminators and wrinkle releasers. Where the surface treating material includes more than one chemical component, it is desirable that the components be combined and processed to form a relatively homogeneous mixture prior to incorporation into the pad 13. The surface treating mixture can be pre-formed into solid particles or a solid surface treating block that inserted into the cavity 18*b* the pad. The surface treating mixture may also be adhered to the layer 12 and/or layer 14 and/or the layer 15. The surface treating mixture can dissolve when contacted with steam and/or water to produce a cleaning solution that flows out of the pad 13 and onto a surface being treated. The heat generated by the pad 13 may also aid dissolution and/or activation of the surface treating material 31. The layer 12 can be used to scrub the surface that receives the surface treating (e.g., cleaning) solution from the pad 13. As used herein, surface treating materials are not limited to materials that contact a surface. For example, a fragrance may treat atmospheric areas adjacent or near a surface.

While a three layer surface treating pad 13 is shown, a single layer pad, a double layer pad, or a pad with four or more layers are also suitable for use in a steam generating device of the invention. Many different shapes for the pad 13 are also possible including, without limitation, circular, elliptical, oval, polygonal, and square. Preferably, the pad 13 has absorbency for liquid and dirt, and porosity for steam to pass through.

One non-limiting example of a single layer pad comprises a non-woven material formed by mechanical entanglement of melt-blown microfibers and wood pulp fibers. The microfibers can be formed from one or polymeric materials such as polyethylene, polypropylene, polyamides, and polyesters (e.g., polyethylene terephthalate). In one example form, the microfibers have an average fiber diameter of about 1 to about 10 microns. Optionally, apertures in the single layer pad can provide a fluid path from a first surface of the single layer pad to an opposed second surface of the single layer pad. The apertures can be located in the single layer pad such that the apertures align with holes 85 in the base 26 of the handle 24 when the single layer pad is attached to the handle 24.

Figure 3:
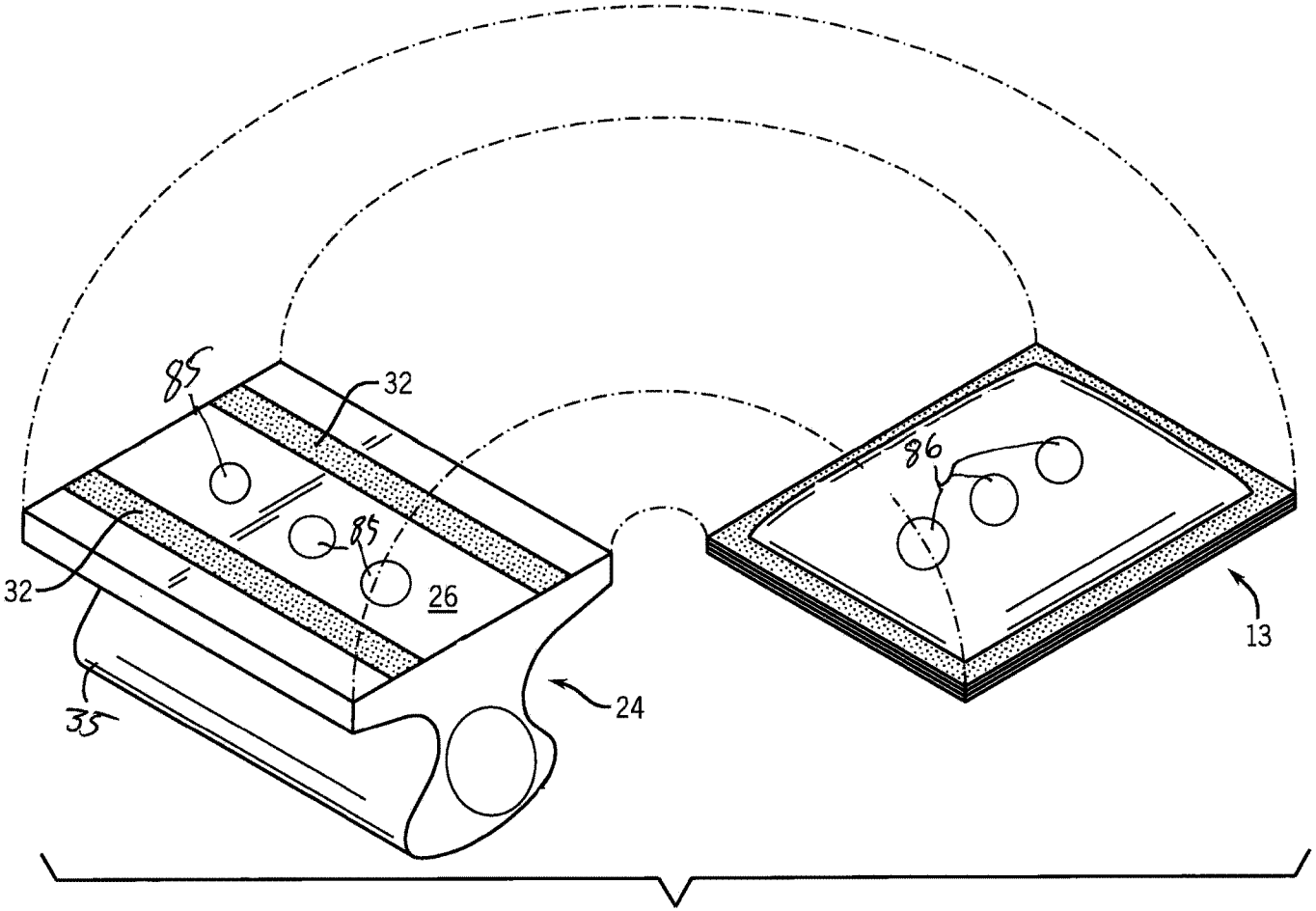
FIG. 3 is a perspective view showing how a pad of FIG. 1 can be mounted on a handle.

Referring next to FIG. 3, the surface treating pad 13 of the present invention can be used in combination with a mounting handle 24. The outer layer 14 of the pad 13 can be constructed to form a first part of a hook and loop attachment system, and strips 32 on the base 26 of the handle 24 can form a second part of a hook and loop attachment system. The handle 24 includes a hand grip 35 for grasping the handle 24 with a user's hand. One example technique for using the pad 13 is to attach the pad 13 to the handle 24, and produce steam (as described below) that flows out of the pad 13 and onto a surface being treated. If the pad 13 includes the surface treating material 31, surface treating (e.g., cleaning) solution also flows out of the pad 13 and onto a surface being treated. After use of the pad 13, the hook-and-loop type attachment system between the bottom of the mounting handle 24 and the first layer 12 of the pad 13 could be physically separated, and the used pad 13 disposed of. A replacement pad 13 could then be abutted against the mounting handle 24 to establish another hook-and-loop connection. However, the pad 13 is not limited to a single use as the pad 13 may be suitable for multiple uses. In one form, the replacement pads can be provided in perforated rolls so users can tear off a new pad in a size required for the intended use. In addition, removable attachment systems other than a hook-and-loop type attachment system can be used for attaching the pad 13 to handle 24.

Figure 4:
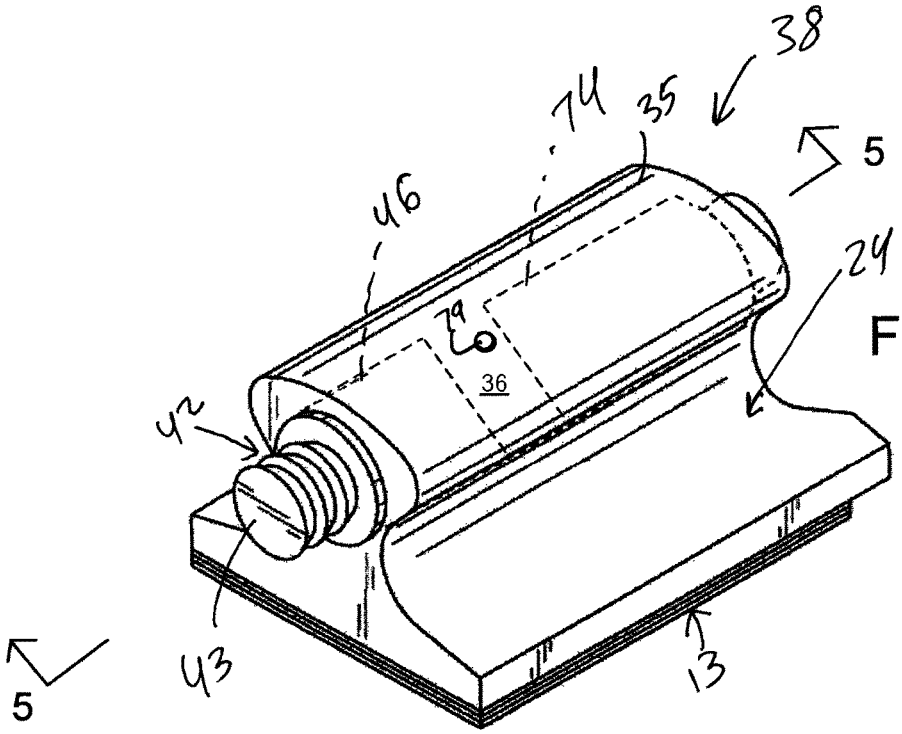
FIG. 4 is a perspective view of a steam generating device of the present invention with the pad of FIG. 1 mounted on such a handle.
Figure 5:
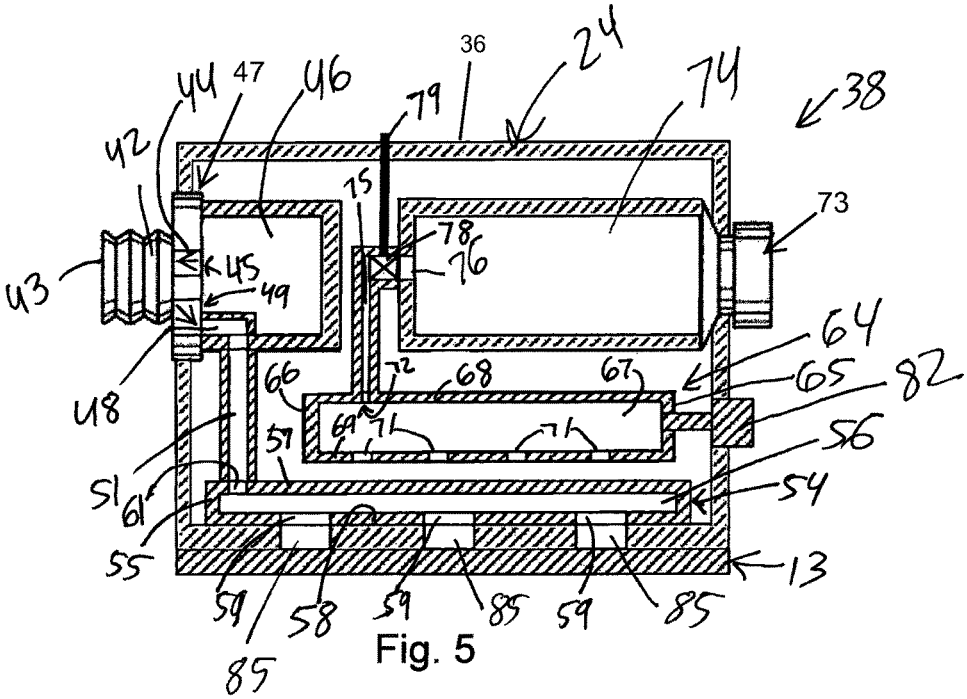
FIG. 5 is a cross-sectional view of the steam generating device of FIG. 4 taken along line 5-5 of FIG. 4.

FIGS. 4 and 5 show one non-limiting example embodiment of a steam generating device 38 according to the invention. A fluid (e.g., water) delivery system is incorporated into the handle 24 of the steam generating device 38. The fluid delivery system includes a bellows pump chamber 42 having an actuator 43 that moves the deformable elastic side walls of the bellows pump chamber 42. The actuator 43 enables the volume of a pump chamber 42 to be varied and a pumping effect is thereby accomplished. The pump chamber 42 communicates through a water supply conduit 44 with a water reservoir 46, so that water (e.g., tap water) can be suctioned from the water reservoir 46 into the pump chamber 42. The water reservoir 46 can be filled with fluid by way of an opening that has a resealable closure, such as internally threaded closure 47.

Inserted in the water supply conduit 44 is a check valve 45 which permits a fluid flow from the water reservoir 46 to the pump chamber 42 while yet preventing a return flow of fluid in the opposite direction. On the downstream side the pump chamber 42, there is a water discharge conduit 48 enabling the fluid to be delivered to a water transfer conduit 51. In the water discharge conduit 48, there is a check valve 49 that permits fluid flow from the pump chamber 42 to the water discharge conduit 48 while preventing a return flow of fluid to the pump chamber 42.

To deliver fluid, pressure exerted a few times on the actuator 43 causes the pump chamber volume to be diminished and to urge the water already contained therein through the water discharge conduit 48. Upon termination of pressure application, the bellows pump chamber 42 returns elastically to its initial position, causing the pump chamber volume to increase again. As a result, fluid is suctioned from the water reservoir 46 through the supply conduit 44 into the bellows pump chamber 42. The check valve 45 is in its position opening the supply conduit 44, while the check valve 49 is pulled into its position closing the water discharge conduit 48. By pressing the actuator 43 again so that the volume of the bellows pump chamber 42 diminishes again, the suctioned fluid in the pump chamber 42 is forced through the water discharge conduit 48 as the check valve 49 is pushed open, while the check valve 45 in the supply conduit 44 closes the supply conduit 44.

Looking at FIG. 5, the handle 24 of the steam generating device 38 includes a heat exchanger 54 having an outer wall 55 that defines an interior space 56 of the heat exchanger 54. The outer wall 55 of the heat exchanger 54 includes a first section 57 spaced from a second section 58. The second section 58 of the wall 55 of the heat exchanger 54 includes openings 59 for passage of steam out of the heat exchanger 54. An inlet 61 of the heat exchanger 54 receives water from the water transfer conduit 51. The heat exchanger 54 can be formed from any suitable material with good heat transfer properties such as stainless steel.

Still referring to FIG. 5, the handle 24 of the steam generating device 38 includes a fuel powered heater 64. The heater 64 has a combustion chamber 65 having an outer wall 66 that defines an interior combustion zone 67 of the combustion chamber 65. The outer wall 66 of the combustion chamber 65 includes a first section 68 spaced from a second section 69. The first section 68 of the wall 66 of the combustion chamber 65 includes a fuel inlet 72. The second section 69 of the wall 66 of the combustion chamber 65 includes openings 71 for passage of heat out of the combustion chamber 65. The combustion chamber 65 can be formed from any suitable heat resistant material such as steel.

The heater 64 includes a fuel container 74 for holding a fuel. A fuel conduit 75 provides a fuel flow path between an outlet 76 of the fuel container 74 and the fuel inlet 72 of the combustion chamber 65. Suitable seals, such as O-rings, can be provided around the outlet 76 of the fuel container 74 to prevent leakage. A fuel metering valve 78 is positioned in the fuel conduit 75 for controlling flow of fuel from the fuel container 74 to the combustion chamber 65. In one non-limiting example form, the fuel metering valve 78 is a needle valve with a threaded plunger 79 (see FIGS. 4 and 5) that can be rotated to open and close the valve 78. The fuel in the fuel container 74 can be a lower hydrocarbon fuel ($C_1$-$C_5$ hydrocarbon), preferably comprising one or more of the following: n-butane, iso-butane, and propane. The fuel container 74 can be loaded into the handle 24 as a disposable pressurized fuel-filled cartridge. Alternatively, the fuel container 74 can be permanently located within the handle 24, and fuel can be charged, as needed, into the fuel container 74 using an external pressurized fuel canister. For example, the external pressurized fuel canister can interface with the cap 73 of the fuel container 74 for fuel charging.

The heater 64 includes an igniter 82 in fluid communication with the combustion zone 67 of the combustion chamber 65. The igniter can ignite fuel in the combustion zone 67 by way of a spark. In one non-limiting example form, the sparking mechanism comprises a piezoelectric material. In the piezoelectric sparking mechanism, sudden forceful deformation of the piezoelectric material by way of a spring loaded hammer produces a high voltage and subsequent electrical discharge, which ignites the fuel. In another non-limiting example form, the sparking mechanism comprises a pyrophoric material. In the pyrophoric sparking mechanism, the pyrophoric material creates sparks when scraped against a rough surface, and the sparks ignite the fuel.

The components of the steam generating device 38 can be arranged in alternative spatial relationships. For example, the top surface 36 of the hand grip 35 of the handle 24 can be curved, or can be flat but inclined at an angle with respect to a flat horizontal surface being treated. The water reservoir 46 can be arranged in the handle 24 such that the closure 47 is at the top surface 36 of the hand grip 35. The igniter 82 may be on the side of the handle 24 but above the fuel container 74, or the igniter 82 may be located on the top surface 36 of the hand grip 35 of the handle 24.

Having described the components of the steam generating device 38, operation of the steam generating device 38 can be explained. A user fills the water reservoir 46 with water, and inserts a fuel-filled fuel container 74 in the handle 24. The pad 13 is attached to the handle 24 as shown in FIG. 3. The threaded plunger 79 of the fuel metering valve 78 is then rotated to open a flow path between the fuel container 74 and the combustion zone 67 of the combustion chamber 65. This causes fuel to enter combustion zone 67 from the fuel container 74. The igniter 82 is activated and the fuel in the combustion zone 67 of the combustion chamber 65 ignites. Heat from the combusting fuel passes out of openings 71 of the combustion chamber 65 and heats the outer wall 55 of the heat exchanger 54.

After the heat exchanger 54 heats up, a user presses the actuator 43 to deliver water from the water reservoir 46 to the heat exchanger 54. The heat exchanger 54 boils the water in the heat exchanger 54 thereby generating steam. The steam passes out through openings 59 in the heat exchanger 54 and through holes 85 in the base 26 of the handle 24. Apertures 86 in the layer 14 of the pad 13 receive steam from the holes 85 and control the passage of the steam through the pad 13. A user treats a surface S (e.g., countertop) by contacting the pad 13 with the surface and moving the pad 13 over the surface. The amount of steam generated can be controlled by controlling the delivery of water to the heat exchanger 54 with the actuator 43 of the fluid delivery system.

Figure 6:
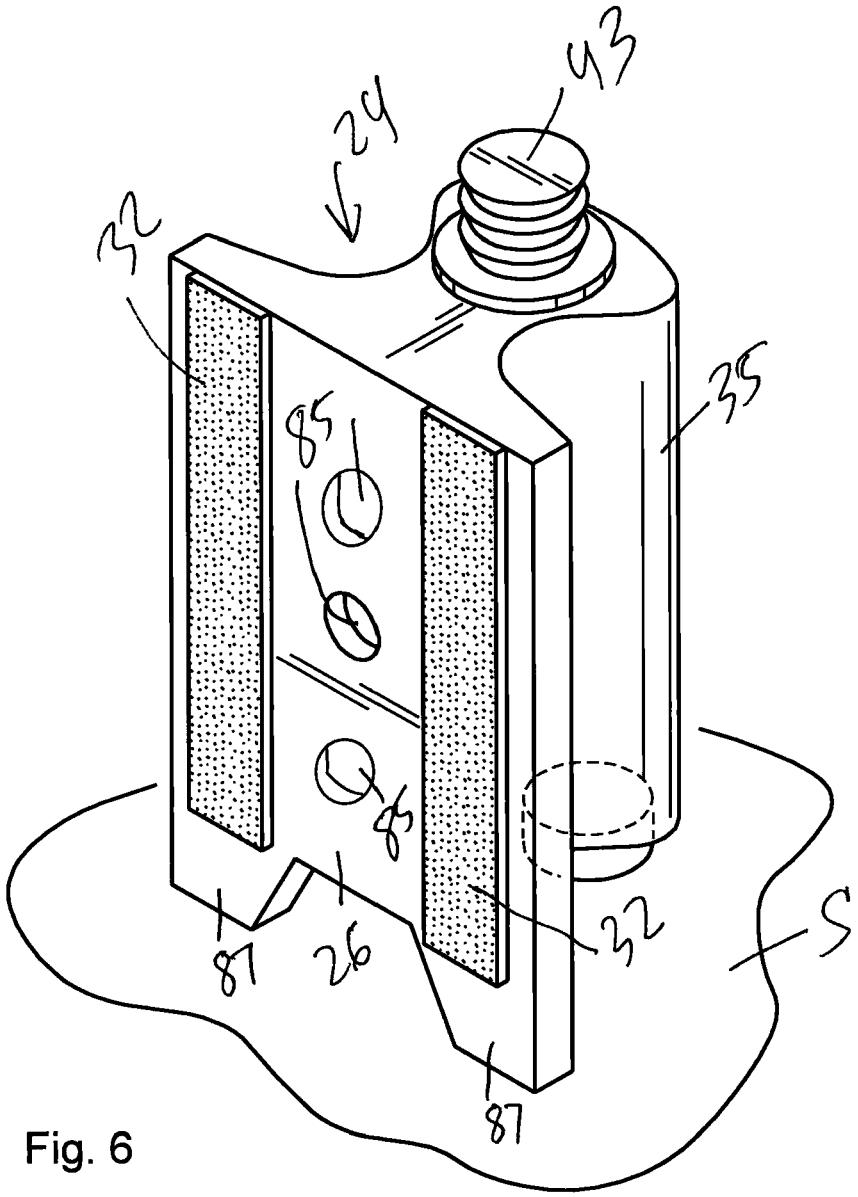
FIG. 6 shows a perspective view of the handle of FIG. 4 in one position used for cooling an attached pad (the pad not being shown in FIG. 6).

After the surface has been treated, the threaded plunger 79 of the fuel metering valve 78 is then rotated to close the flow path between the fuel container 74 and the combustion zone 67. This causes fuel combustion and steaming to stop. The handle 24 and attached pad 13 can then be cooled by resting the handle on feet 87 of the handle as shown in FIG. 6. The cooled pad 13 can be removed from the handle 24 and thrown in the trash. Alternatively, the pad 13 can be left on the handle 24 for later reuse.

The water can metered into a heat exchanger 54 at a rate commensurate with heat generation from fuel combustion such that a low temperature steam is produced at the holes 85 of the handle 24. "Low temperature steam" means steam in a temperature range of about 175° F. to about 300° F., preferably about 190° F. to about 220° F. Preferably, the steam generating device 38 converts about 1 to about 10 grams of water per minute to steam, more preferably about 2-5 grams of water per minute to steam. Steam is expelled from the device along with the products of fuel combustion (carbon dioxide and additional water vapor). Preferably, the steam is sufficient in temperature and volume as to be capable of disinfecting or sanitizing the surface(s) to be treated in addition to the cleaning desired. The metering of water into the heat exchanger 54 can also be accomplished by a self-powered valve system (venturi valve, spring pressure or other such non-powered valve system), capillary action through the use of a substance with wicking properties, or by the use of a battery driven mechanical pumping device.

Figure 7:
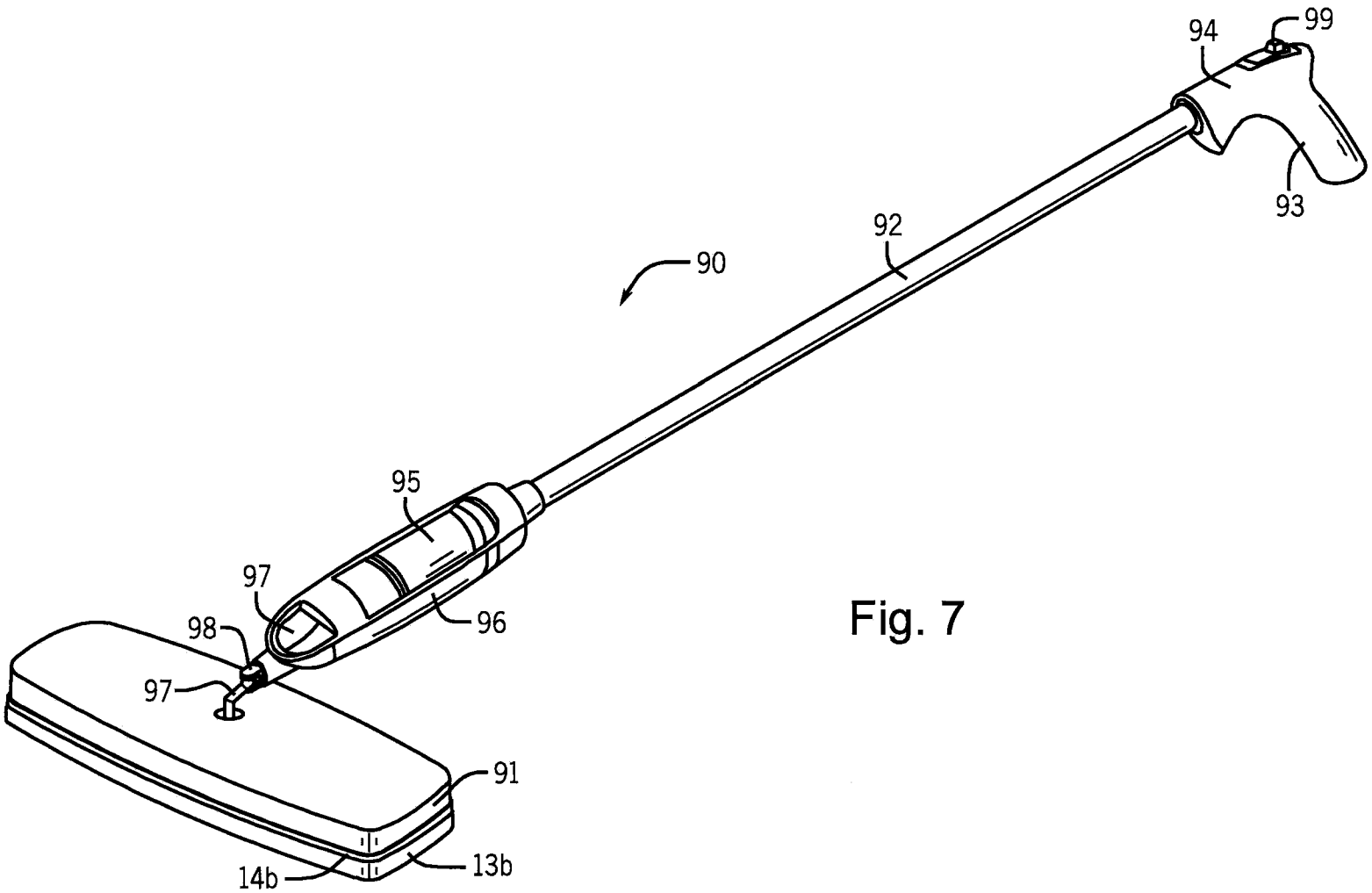
FIG. 7 is a perspective view of a pad of FIG. 1 mounted on another mop-type handle that provides for water delivery to the heat exchanger.

Turning now to FIG. 7, there is shown a mop-type handle 90 that includes a source of water for providing water to a heat exchanger located in a base 91 connected to a hollow elongated shaft 92. The base 91 also houses a heater located near the heat exchanger as in FIG. 5. A hand grip 93 is attached to an end section 94 of the shaft 92. A water reservoir 95 placed in a housing 96 on the shaft 92. A water conduit 97 is in fluid communication with the reservoir 95 and the heat exchanger. A valve 98 is provided in the water conduit 97 to control a flow of water from the reservoir 95 to the heat exchanger. A user-operated actuating trigger 99 on the hand grip 93 is linked to the valve 98 to allow the user to open and close the valve 98 to allow water to selectively flow to the heat exchanger. Pad **13*b* with an attachment layer 14*b* is shown attached to the handle 90. The heater is activated as described above and the trigger 99** provides water to the heat exchanger for steaming a floor.

Figure 8:
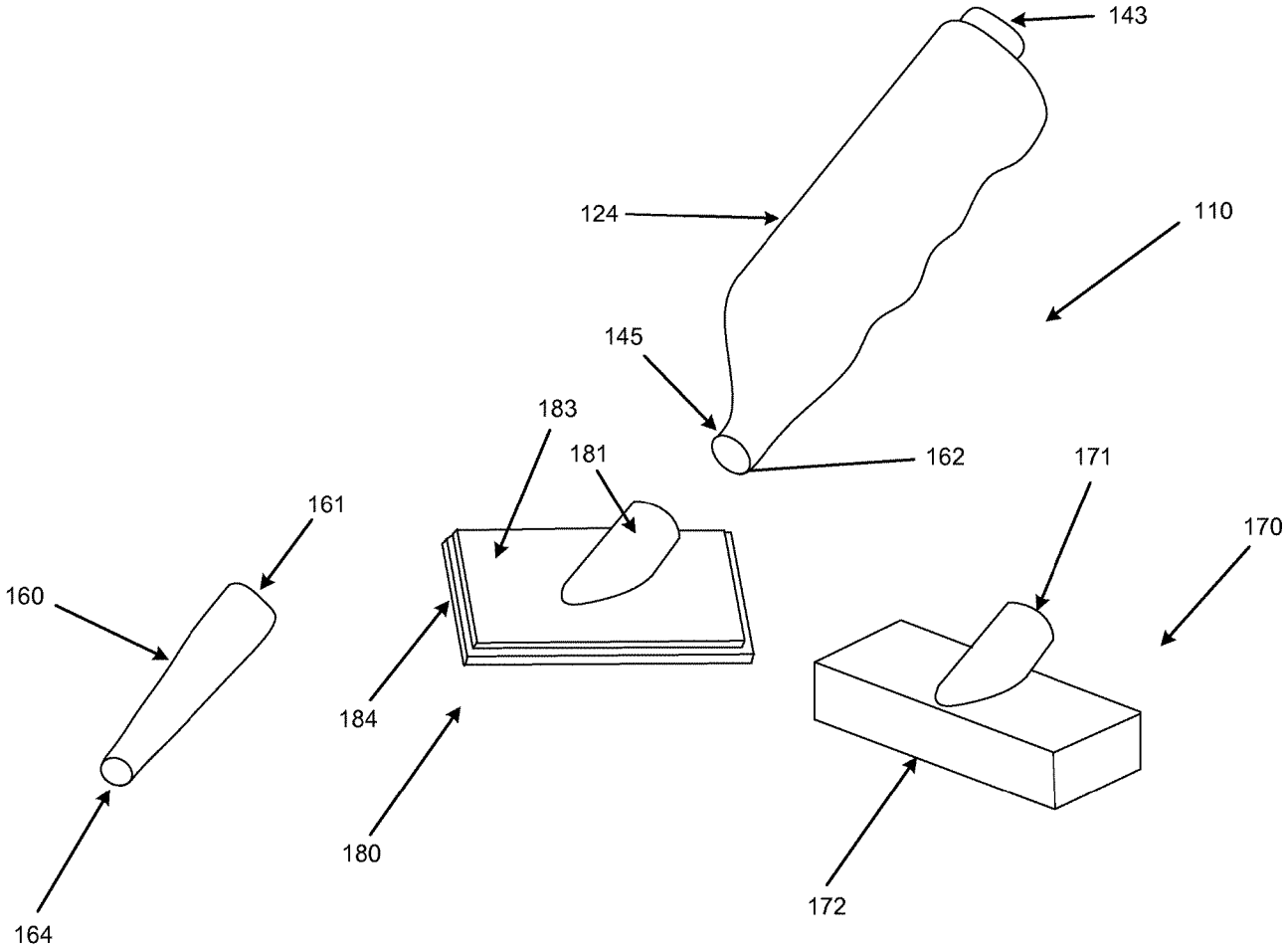
FIG. 8 is a top, front right perspective view of another embodiment of a steam generating device according to the present invention.
Figure 9:
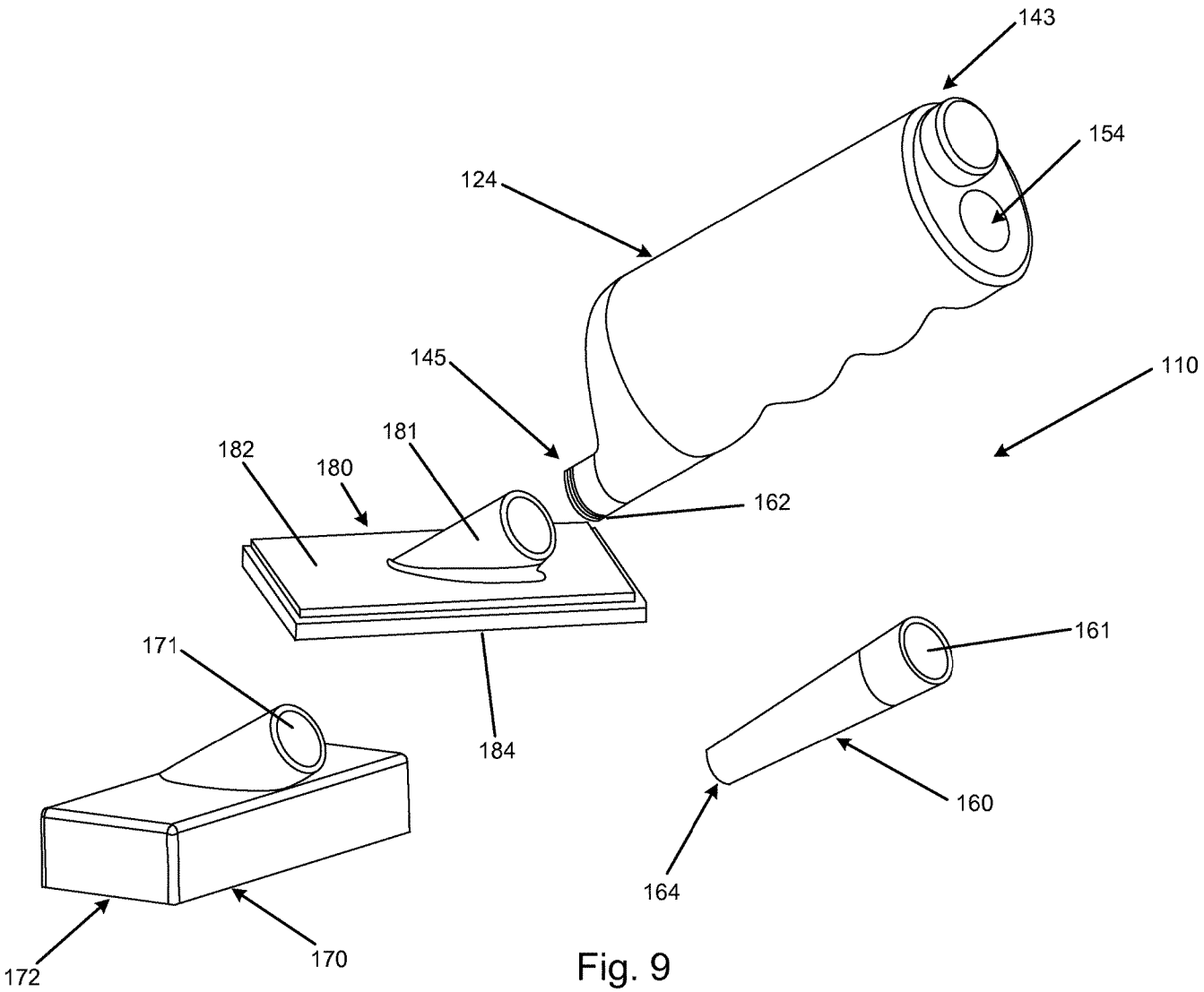
FIG. 9 is a top, rear, right perspective view of the steam generating device of FIG. 8.

Looking now at FIGS. 8 and 9, there is shown another non-limiting example embodiment of a steam generating device 110 according to the present invention. A fluid (e.g., water) delivery system is incorporated into a generally cylindrical handle 124 of the steam generating device 110. The fluid delivery system can include the same components as in the steam generating device 38 of FIGS. 4 and 5. To deliver fluid, pressure exerted a few times on an actuator 143 causes a pump chamber volume to be diminished and to urge the water already contained in the pump chamber into a heat exchanger.

A fuel powered heater heats the water in the heat exchanger such that steam exits one or more openings in the heat exchanger and flows out of an opening 145 in the handle 124. The heater can include the same components as in the steam generating device 38 of FIGS. 4 and 5. The heater includes a fuel container 154 for holding a fuel. A fuel conduit provides a fuel flow path between an outlet of the fuel container 154 and a fuel inlet of a combustion chamber. A fuel metering valve is positioned in the fuel conduit for controlling flow of fuel from the fuel container 154 to the combustion chamber. The fuel container 154 can be loaded into the handle 124 as a disposable pressurized fuel-filled cartridge. Alternatively, the fuel container 154 can be permanently located within the handle 124, and fuel can be charged into the fuel container 154 using an external pressurized fuel canister. An igniter can ignite fuel in the combustion chamber by way of a spark.

The steam generating device 110 can include one or more removable steam nozzles for attachment to the opening 145 in the handle 124. One non-limiting example steam nozzle 160 includes an inlet 161 that removably engages the outside surface of a tubular wall 162 that defines the opening 145 in the handle 124. The inlet 161 can be held in place on the outside surface of a tubular wall 162 by way of an interference fit. An inner surface of the tubular nozzle 160 converges from the inlet 161 of the nozzle 160 to an outlet 164 of the nozzle such that the nozzle 160 emits a focused plume or stream of steam useful for treating small spaces and irregularly shaped objects, such as faucets. The steam nozzle 160 can be formed from a suitable polymeric material such as polyethylene or polypropylene.

Another non-limiting example steam nozzle 170 includes an inlet 171 that removably engages the outside surface of the tubular wall 162 that defines the opening 145 in the handle 124. The inlet 171 can be held in place on the outside surface of a tubular wall 162 by way of an interference fit.

A longitudinal axis of the inlet 171 is angled obliquely with respect to a cuboid-shaped outlet 172 of the steam nozzle 170. The outlet 172 can also be formed in an alternative shape having a circular, oval, square or polygonal perimeter. The removable steam nozzle attachment 170 can direct the emission of steam for treating larger flat surfaces such as tables/countertops. The outlet 172 of the steam nozzle 170 may also be optionally fitted with a small brush/bristle head to provide a scrubbing action when treating a surface with steam. The steam nozzle 170 can be formed from a suitable polymeric material such as polyethylene or polypropylene.

Yet another non-limiting example steam nozzle 180 includes an inlet 181 that removably engages the outside surface of the tubular wall 162 that defines the opening 145 in the handle 124. The inlet 181 can be held in place on the outside surface of a tubular wall 162 by way of an interference fit. A longitudinal axis of the inlet 181 is angled obliquely with respect to a cuboid-shaped outlet 182 of the steam nozzle 180. The removable steam nozzle 180 can direct the emission of steam for treating larger flat surfaces such as tables/countertops. The removable steam nozzle 180 is fitted with a disposable/reusable fluid permeable cleaning cloth 184 to enhance cleaning of flat surfaces. The cloth 184 covers the outlet 182, which can also be formed in an alternative shape having a circular, oval, square or polygonal perimeter. The steam nozzle 180 can be formed from a suitable polymeric material such as polyethylene or polypropylene. The cloth 184 may be formed from a non-woven material such as the materials described with reference to the pad 13 above.

Thus, the invention provides a steam generating device intended to function as a cordless portable hand-held unit. In one mode, the device emits a focused plume or stream of steam useful for treating small spaces and irregularly shaped objects, such as faucets. The steam outlet may also be optionally fitted with an adaptor having a small brush/bristle head to provide a scrubbing action when treating a surface with steam. Preferably, the device can be optionally fitted with a steam outlet attachment which directs the emission of steam to a flat, pad-like outlet, suitable for treating larger flat surfaces such as tables/countertops. Preferably, the pad-like steam outlet is fitted with a disposable/reusable cleaning cloth to enhance cleaning of flat surfaces. In one embodiment, the device is largely cylindrical in shape (other than the outlet adaptors), to facilitate use in smaller spaces and ease of being held in one's hand.

Although the present invention has been described in detail with reference to certain embodiments, one skilled in the art will appreciate that the present invention can be practiced by other than the described embodiments, which have been presented for purposes of illustration and not of limitation. Therefore, the scope of the invention should not be limited to the description of the embodiments contained herein.

INDUSTRIAL APPLICABILITY

The present invention provides a portable steam generating pad for treating hard surfaces, such as floors, walls, countertops, sinks, bathtubs, toilets and other bathroom fixtures, and/or soft surfaces, such as fabric or carpet.

What is claimed is:

1. A portable steam generating device comprising:

a handle including a first end and a second end, the handle also including a heat exchanger having a wall defining an interior space of the heat exchanger, a water reservoir positioned adjacent the first end of the handle, a fluid conduit in fluid communication with the water reservoir and the interior space of the heat exchanger, a fluid delivery system for moving water from the water reservoir, through the fluid conduit, and into the interior space of the heat exchanger, and a fuel powered heater positioned adjacent the second end of the handle and on a side of the wall of the heat exchanger opposite the interior space of the heat exchanger, a first section of the wall of the heat exchanger transferring heat from the heater to water located in the interior space of the heat exchanger for generating steam from the water located in the interior space of the heat exchanger; and a fluid permeable pad attached to the handle, wherein a second section of the wall of the heat exchanger includes an opening that allows steam to exit the interior space of the heat exchanger and exit the handle and flow through the pad.

2. The device of claim 1 wherein:

the pad includes a first layer bound to a second layer, and the second layer is constructed to form a first part of an attachment system, and the handle is constructed to form a second part of the attachment system, the handle being attached to the second layer.

3. The device of claim 2 wherein:

the second layer includes an aperture, and the aperture is positioned in the second layer such that the aperture aligns with the opening in the second section of the wall of the heat exchanger when the pad is attached to the handle.

4. The device of claim 1 wherein:

the heater comprises a combustion chamber.

5. The device of claim 4 further comprising:

an igniter in fluid communication with a combustion zone defined by the combustion chamber, the igniter igniting fuel in the combustion zone.

6. The device of claim 4 wherein:

the heater further comprises a source of fuel and a fuel conduit in fluid communication with the source of fuel and the combustion chamber.

7. The device of claim 6 wherein:

the heater further comprises a fuel metering valve in the fuel conduit, the fuel metering valve having a closed position in which fuel cannot move from the source of fuel and through the fuel conduit, and into the combustion chamber, and the fuel metering valve having an open position in which fuel can move from the source of fuel, and through the fuel conduit, and into the combustion chamber.

8. The device of claim 6 wherein:

the source of fuel comprises a disposable pressurized fuel-filled cartridge.

9. The device of claim 6 wherein:

the source of fuel comprises a fuel storage chamber located within the handle, the fuel storage chamber suitable for fluidly interfacing with an external pressurized fuel canister for refilling the fuel storage chamber.

10. The device of claim 6 wherein:

the fuel is selected from butane, isobutane and propane.

11. The device of claim 1 wherein:

the fluid delivery system meters water into the heat exchanger at a rate commensurate with heat generation from the heater such that a low temperature steam exits the handle.

12. The device of claim 10 wherein:

the fluid delivery system includes a variable volume pump chamber in fluid communication with the water reservoir and the fluid conduit, the variable volume pump chamber moving water from the water reservoir, through the fluid conduit, and the interior space of the heat exchanger.

13. The device of claim 12 wherein:

the volume of the pump chamber is varied by an actuator on the handle.

14. The device of claim 1 wherein:

the device converts about 1 to about 10 grams of water per minute to steam, and the steam exiting the device is in a temperature range of about 175° F. to about 300° F.

15. The device of claim 1 wherein:

at least a portion of the fluid delivery system extends through the first end of the handle.

16. The device of claim 1 wherein:

the fuel powered heater includes a fuel storage chamber configured to interface with an external pressurized fuel canister through the second end of the handle for refilling the fuel storage chamber.

* * * * *